US008652227B2

(12) United States Patent
Miyasaka

(10) Patent No.: US 8,652,227 B2
(45) Date of Patent: Feb. 18, 2014

(54) ABRASIVE CLEANING AGENT, METHOD FOR MANUFACTURING THE SAME, AND METHOD FOR POLISHING USING ABRASIVE CLEANING AGENT

(71) Applicant: Fuji Kihan Co., Ltd, Aichi (JP)

(72) Inventor: Yoshio Miyasaka, Aichi (JP)

(73) Assignee: Fuji Kihan Co. Ltd, Aichi (JP)

( * ) Notice: Subject to any disclaimer, the term of this patent is extended or adjusted under 35 U.S.C. 154(b) by 0 days.

(21) Appl. No.: 13/927,282

(22) Filed: Jun. 26, 2013

(65) Prior Publication Data

US 2013/0288945 A1 Oct. 31, 2013

Related U.S. Application Data

(62) Division of application No. 12/214,705, filed on Jun. 19, 2008, now Pat. No. 8,529,650.

(30) Foreign Application Priority Data

Jun. 20, 2007 (JP) ..... 2007-162846

(51) Int. Cl.

| | |
|---|---|
| ***B24D 3/02*** | (2006.01) |
| ***C09C 1/68*** | (2006.01) |
| ***C09K 3/14*** | (2006.01) |
| ***C11D 9/20*** | (2006.01) |

(52) U.S. Cl.
USPC ..... 51/307; 51/302; 510/395

(58) Field of Classification Search
USPC ..... 51/307, 302; 510/395
See application file for complete search history.

(56) References Cited

U.S. PATENT DOCUMENTS

2006/0127557 A1 6/2006 Takata

FOREIGN PATENT DOCUMENTS

| | | |
|---|---|---|
| JP | 63272458 | 11/1988 |
| JP | 2001038629 | 2/2001 |
| JP | 2003250717 A | 9/2003 |
| JP | 2004345022 | 12/2004 |
| JP | 2007111957 | 5/2007 |

OTHER PUBLICATIONS

European Search Report dated Sep. 19, 2008.

*Primary Examiner* — Shuangyi Abu Ali
(74) *Attorney, Agent, or Firm* — Cooper Legal Group, LLC

(57) ABSTRACT

An abrasive cleaning agent is provided which can be used for a polishing process for polishing a surface of a workpiece to form a mirror surface, which suppresses generation of static electricity and adhesion of stains to the workpiece, which decreases a crushing ratio, and which has a low environmental burden when the abrasive cleaning agent is disposed of. The above abrasive cleaning agent includes an elastic material containing a soluble nitrogen substance as a primary component, which is obtained from tubers of devil's tongue and which contains mannan as a primary component, and a 10% to 30% of water; and 1 to 30 percent by weight, with respect to the elastic material, of abrasive grains of size 53 micron or less, which are supported on surfaces of the elastic material and/or are buried therein, so that the grain diameter on the whole is in the range of 88 to 1,190 μm.

1 Claim, 6 Drawing Sheets

EXAMPLE 1 DEVIL'S TONGUE#46-60+SiC#800/0.1MPa TREATMENT

UNTREATED SAMPLE 1×100

TREATED SAMPLE 1×100

EXAMPLE 2 DEVIL'S TONGUE #60-80+EMB - 20/0.5MPa TREATMENT

UNTREATED SAMPLE 2×100

TREATED SAMPLE 2×100

EXAMPLE 3 DEVIL'S TONGUE #60-80+Shinano Electric Refining Co., Ltd. #3000/0.075MPa TREATMENT

UNTREATED SAMPLE 3×100

TREATED SAMPLE 3×100

EXAMPLE 4 DEVIL'S TONGUE #60～80+WA#1000/0.075MPa

UNTREATED SAMPLE 4×100

TREATED SAMPLE 4×100

COMPARATIVE EXAMPLE 1 MELAMINE #60～80+WA#1000/0.075MPa

UNTREATED SAMPLE 1×100

TREATED SAMPLE 1×100

ABRASIVE CLEANING AGENT, METHOD FOR MANUFACTURING THE SAME, AND METHOD FOR POLISHING USING ABRASIVE CLEANING AGENT

RELATED APPLICATION

Priority of U.S. patent application Ser. No. 12/214,705 is hereby claimed and the entire contents thereof is expressly incorporated herein by reference.

BACKGROUND OF THE INVENTION

1. Field of the Invention

The present invention relates to an abrasive cleaning agent, a method for manufacturing the same, and a method for polishing using the above abrasive cleaning agent, and more particularly relates to an abrasive cleaning agent comprised of an elastic material used as a core material and abrasive grains which are compounded therewith or which are supported, carried and/or surrounded on surfaces of the elastic material, a method for manufacturing the abrasive cleaning agent, and a method for polishing using the same for polishing an article to be treated (hereunder, simply called a "workpiece") to form a mirror surface or the like.

2. Description of the Related Art

According to a known lapping technique in which a workpiece is polished to form a mirror surface or the like, it has been difficult to polish a workpiece having a complicated three-dimensional shape, a microfabricated workpiece, or the microfabricated part of a workpiece, and hence in recent years, a technique has been developed in which a polishing process as described above is performed by ejecting an abrasive cleaning agent onto a workpiece.

The polishing process using an abrasive cleaning agent, as described above, is performed by ejecting an abrasive polishing agent, a so-called "elastic abrasive", which is an agent including an elastic material, such as a synthetic rubber or a synthetic resin, used as a core material and fine abrasive grains which are supported on surfaces of the elastic material or which are compounded therewith. When the abrasive cleaning agent as described above is used, a cutting force applied to a workpiece is reduced, and the polishing process can be performed on the workpiece to form a mirror surface or the like without forming irregularities and so forth on a surface of the workpiece.

An example of a polishing process using the abrasive cleaning agent as described above is a process in which an abrasive cleaning agent is ejected in a dry state onto a workpiece using a blasting machine.

In addition, a process has been proposed in which diamond abrasive grains, which are processed with an aqueous "multi-solution" instead of the above-described elastic material, such as a synthetic rubber or a synthetic resin, are ejected onto a workpiece.

In addition, although not for the purpose of polishing a workpiece to form a mirror surface or the like, the applicant of the present invention has proposed the use of dried and pulverized underground tubers of devil's tongue starch (devil's tongue: also called "konjak" or "konnyaku" which is a jelly-like food made from the starch of devil's longue; scientific name: Amorphophallus konjac, hereinafter also called "tubers of devil's tongue") as an abrasive cleaning agent for a blasting process, such as flash (burr) removal (deburring), removal of adhering material, removal of coated films, and cleaning, to be performed on a workpiece instead of an abrasive cleaning agent obtained by pulverizing known food grains and seed shells (see Japanese Unexamined Patent Application Publication No. 2001-38629, and Japanese Patent No. 3899209).

Among the abrasive cleaning agents used in these described related techniques, when the abrasive cleaning agent in which abrasive grains are supported on an elastic material, such as a synthetic rubber or a synthetic plastic, or are compounded therewith is disposed of after use, it is not naturally decomposed by biodegradation or the like even if buried in the ground, and when the abrasive cleaning agent is processed by incineration or the like, for example, $CO_2$ and other harmful gases are generated; hence, when the abrasive cleaning agent is disposed of, the environmental burden is increased. Accordingly, the above abrasive cleaning agent does not meet the current social demand which requires products and the like to have a low environmental burden.

In addition, in the case in which a polishing process is performed using the abrasive cleaning agent as described above, when the above abrasive cleaning agent containing a synthetic rubber or a synthetic resin as the elastic material is used under dry conditions, static electricity is generated, and hence, for example, dust in the air, the abrasive grains, a crushed powder generated in the process, or the like may disadvantageous adhere to the workpiece due to this static electricity. Furthermore, for example, the abrasive cleaning agent may adhere to an inside wall of a cabinet in the blasting machine, and hence problems may arise in that circulation and/or recovery of the abrasive cleaning agent cannot: be easily performed.

Furthermore, when a synthetic resin material, such as a melamine resin material, is used as the elastic material, in addition to the above-described problems, as a result of ejecting to and collision with the workpiece, the abrasive cleaning agent and in particular, the elastic material may be crushed. As a result, since the crushing ratio is high, and the amount of abrasive cleaning agent which can be reused after being recovered is small, the cost therefor is increased. In addition, the working environment may be diminished in some cases due to the generation of a large amount of dust.

It has been conceived that, in order to decrease the crushing ratio, a synthetic rubber or a synthetic plastic used as the elastic material should be foamed to further increase the elasticity so that crushing is unlikely to occur. However, since the bulk density of an abrasive cleaning agent using the foamed elastic material as described above is decreased, the processability thereof is diminished, and as a result, the conditions for process are restricted such as ejection has to be performed on a workpiece at high pressure or at high velocity.

On the other hand, according to a known technique in which diamond abrasive grains which are processed with a predetermined aqueous solution are ejected, the problem of electrostatic generation is solved since the abrasive grains are ejected with the aqueous solution; however, the aqueous solution, which is used together with the diamond abrasive grains, adheres to the workpiece, and as a result, the workpiece is contaminated thereby. In particular, when the workpiece is formed of a material which is liable to rust, such as steel, in order to prevent the generation of rust caused by the adhering aqueous solution, as described above, the aqueous solution adhering to the workpiece must be removed as soon as possible, and the operation for doing so is very complicated.

In addition, as described above, the applicant of the present invention has proposed the abrasive cleaning agent formed by using devil's tongue as a raw material (disclosed in Japanese Unexamined Patent Application Publication No. 2001-38629); however, although this abrasive cleaning agent can be used for deburring, removal of adhering material, removal of coated films, cleaning, and the like without changing the surface of a workpiece into a satin finished surface, this abrasive cleaning agent cannot be used for a polishing process in which a surface of a workpiece is actively processed to form a mirror surface or the like.

Accordingly, the present invention has been conceived in order to solve the problems of the above related techniques, and an object of the present invention is to provide an abrasive cleaning agent that can solve the above problems, a method for manufacturing the same, and a method for polishing using the abrasive cleaning agent. By using this abrasive cleaning agent, a surface of a workpiece can be easily polishing processed into a mirror surface or the like by using a relatively simple method in which the abrasive cleaning agent is ejected onto the workpiece, and furthermore, in addition to suppressed generation of static electricity and reduced contamination adhering to the workpiece, recycling of the abrasive cleaning agent can be performed since the crushing ratio thereof is small. In addition, since the specific gravity of the abrasive polishing agent is high, even when it is ejected at a relatively low ejection pressure and/or ejection velocity, the workpiece can be suitably processed. Furthermore, in the case in which the abrasive cleaning agent is disposed of after use, it can be returned to the ground by biodegradation or the like when being buried therein, and also, even in the case in which an incineration treatment is performed on the abrasive cleaning agent, it is not necessary to be concerned with the generation of $CO_2$ gas and other harmful gases.

SUMMARY OF THE INVENTION

In the following explanation of the Summary, reference numerals are referred as of the Embodiment in order to easily read the present invention, however, these numerals are not intended to restrict the invention as of the Embodiment.

To realize the object described above, an abrasive cleaning agent of the present invention comprises an elastic material which includes a soluble nitrogen substance as a primary component, obtained from underground tubers of devil's tongue starch and containing mannan as a primary component, and whose water content is 10% to 30%; and abrasive grains of size #220 or less, which are provided in an amount of 1 to 30 percent by weight, with respect to the elastic material, and which are supported on surfaces of the elastic material and/or are buried in the elastic material, wherein the grain diameter on the whole is from 88 to 1,190 μm.

In addition, the above abrasive cleaning agent may be obtained by adding water and the abrasive grains to a devil's tongue powder obtained by milling tubers of dried devil's tongue, stirring and heating to form a mixed material: solidifying the mixed material by a reaction with an alkali to form a solidified material, for example, by adding a sodium carbonate solution or lime water to the mixed material or by extruding the mixed material in the form of thread shapes into a sodium carbonate solution or lime water; drying the solidified material so as to have a water content of 10% to 30%; followed by pulverizing the dried material to a grain diameter of 88 to 1,190 μm.

In addition, besides the tubers of dried devil's tongue, the abrasive cleaning agent may be obtained from tubers of raw devil's tongue. In this case, the abrasive cleaning agent may be obtained by stirring and heating raw or grated tubers of devil's tongue together with water and the abrasive grains to form a mixed material; solidifying the mixed material by a reaction with an alkali to form a solidified material; drying the solidified material to have a water content of 10% to 30%; followed by pulverizing the dried material to a grain diameter of 88 to 1,190 μm.

The upper limit of the addition amount of the abrasive grains is 30 percent by weight for maintaining the elasticity and adhesive properties of the elastic material, and a method for polishing according to the present invention comprised the step of ejecting the abrasive cleaning agent onto a workpiece at an acute incident angle using a dry ejecting method with an ejection velocity of 30 m/s or more or an ejection pressure of 0.05 MPa or more.

As has thus been described, according to the configuration of the present invention, because of the elasticity and appropriate adhesive properties of the elastic material, the abrasive cleaning agent of the present invention can slide on a surface of a workpiece when being ejected thereon and can process for polishing the surface of the workpiece, for example, into a mirror surface.

Since the elastic material of this abrasive cleaning agent is obtained from a vegetable, that is, from tubers of devil's tongue, as described above, for example, even when the abrasive cleaning agent is buried in the ground for disposal after use, the abrasive cleaning agent is returned to the soil by biodegradation or the like, and even when the abrasive cleaning agent is processed by an incineration treatment, $CO_2$ and other harmful gases are not emitted at all; hence, the abrasive cleaning agent of the present invention has a significantly low environmental burden.

In addition, since the elastic material of this abrasive cleaning agent contains an appropriate amount of water, even when it collides with a workpiece, an inner wall of a cabinet of a blasting machine, or the like, hardly any static electricity is generated, and in addition, since mannan, which is a primary component of the soluble nitrogen substance which is a primary component of this elastic material, is solidified in a hydrated state by a reaction with an alkali, and the water content thereof is appropriately adjusted, adhesion of water to the workpiece does not occur. As a result, an operation for removing the adhering water, such as wiping, is not necessary.

Furthermore, since the abrasive cleaning agent of the present invention, which contains a relatively large water content, also has a relatively large bulk density, a desired polishing process can be performed even when an ejection is performed at a relatively low ejection pressure and ejection velocity. As a result, the energy necessary for ejecting can be decreased.

According to the abrasive cleaning agent in which the abrasive grains are supported on the surfaces of the elastic material, since the abrasive grains are exposed on the surfaces of the abrasive cleaning agent, by ejecting the abrasive cleaning agent to a workpiece, it can be reliably brought into contact with a surface of the workpiece, and hence the polishing process can be reliably performed.

In addition, according to the abrasive cleaning agent in which the abrasive grains are buried in the elastic material, some of the abrasive grains buried in the vicinity of the surfaces of the elastic material are exposed on the surfaces thereof and exhibit polishing properties, and in addition, even when some abrasive grains in the vicinity of the surfaces fall out, since some of the abrasive grains buried inside arc exposed when the elastic material is partly polished away, for example, because of friction with a workpiece. the polishing ability is not diminished, hence providing an abrasive cleaning agent which can be repeatedly used.

BRIEF DESCRIPTION OF THE DRAWINGS

The objects and advantages of the invention will become apparent from the following detailed description of preferred embodiments thereof provided in connection with the accompanying drawings in which.

DETAILED DESCRIPTION OF THE PREFERRED EMBODIMENT'S

Figure 1:
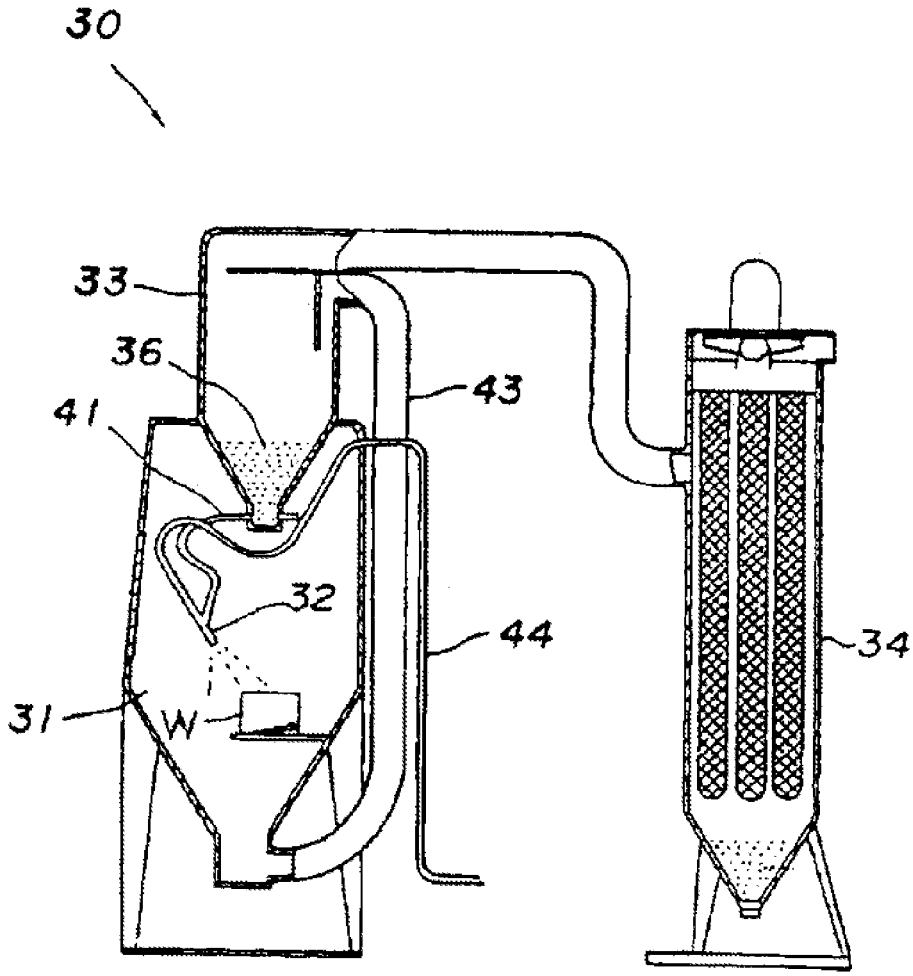
FIG. 1 is a schematic view of a suction-type blasting machine, which is one example of an ejection apparatus ejecting an abrasive cleaning agent.

Next, the embodiments of the present invention will be described.

Abrasive Cleaning Agent

An abrasive cleaning agent of the present invention, used for a polishing process which processes a workpiece to have a mirror surface, includes an elastic material including a soluble nitrogen substance as a primary component, which is obtained from tubers of devil's tongue and which contains mannan as a primary component, and whose water content is 10% to 30%: and abrasive grains of size #220 or less, which are provided in an amount of 1 to 30 percent by weight, with respect to the elastic material, and which are supported on surfaces of the elastic material or are buried in the elastic material, wherein the grain diameter on the whole is from 88 to 1,190 μm.

The abrasive cleaning agent as described above can be manufactured by one of the following methods, which are mentioned by way of example.

Method 1 for Manufacturing Abrasive Cleaning Agent

After tubers of devil's tongue are sliced by a potato slicer into chip shapes, the sliced tubers are dried by various known drying methods, such as natural drying, including sun drying or air drying, and drying using heat generated when a fuel, such as a gas fuel or a petroleum fuel, is burnt. Subsequently, the tubers thus processed are pulverized by a pulverizer, such as a roll mill, followed by sieving, so that particles having a diameter of 149 to 250 μm or less are obtained. Next, 10 to 20 percent by weight of water is added to the pulverized tubers so as to enable mannan, which is a primary component of the pulverized tubers, to absorb water, and as a result, yielding an elastic material, which has elasticity and adhesive properties and which is to be used as a core material forming an abrasive cleaning agent.

The abrasive cleaning agent described above can be manufactured by adhering abrasive grains of size #220 (average particle diameter: approximately 53 μm) or less, and preferably from size #320 (average of average particle diameter: 62-52.5 μm) to #10,000 (average particle diameter: approximately 1 μm), comprised of a metal, a ceramic, or a mixture thereof, to surfaces of the elastic material thus obtained in an amount of 1 to 30 percent by weight, and preferably 5 to 10 percent by weight, with respect to the elastic material.

Although mesh screens are defined only up to size #3.000 according to JISR6001-1973, size #8,000 (average particle diameter: approximately 1.2 μm) and #10.000 are generally used.

Method 2 for Manufacturing Abrasive Cleaning Agent

As another method for manufacturing the abrasive cleaning agent of the present invention, for example, after pulverized tubers of devil's tongue sliced and then dried, as described above, and further milled by using a known devil's tongue milling machine into powder, and it can be obtained a devil's tongue powder in refraining from starch or fibers. While water in an amount of approximately 10 times that of this devil's tongue powder and 1 percent by weight or more, and preferably 10 percent by weight or more, of abrasive grains is being added to the devil's tongue powder, adequate stirring is performed, and after water in an amount similar to that described above is further added, the mixture thus obtained is held for a predetermined time (approximately 1 hour) if necessary. Subsequently, after heating is performed to form a mixed material, a sodium carbonate solution or lime water at a concentration of 10% and in an amount of one tenth of that of the mixed material is added thereto and stirred together so as to solidify the mixed material.

The solidification is performed in a container which is used for heating and compounding, and after the mixed material is solidified, the solidified material may be cut into an appropriate size, or when the mixed material starts to solidify in a container used for heating and compounding, it may be poured into a mold, which is separately prepared, to form an appropriate shape. The solidified material thus obtained is dried so as to have a water content of approximately 20%, and after drying, pulverizing and sieving are performed, so that an abrasive cleaning agent between size #60 (average particle diameter: approximately 250 μm) and #80 (average particle diameter: approximately 149 μm) is obtained.

In the abrasive cleaning agent thus obtained, the abrasive grains compounded with the elastic material are exposed at surfaces of the pulverized abrasive cleaning agent and exhibit their polishing properties when brought into contact with a surface of a workpiece. In addition, even if some abrasive grains in the vicinity of the surfaces fall out, when the elastic material is partly polished away by contact and friction with the workpiece, the abrasive grains buried inside are exposed; hence, the polishing ability is not diminished for a long period of time, and the abrasive cleaning agent can be repeatedly used for a long period of time.

In the above example, when the mixed material is solidified, it is described that solidification is performed by adding an alkali to the mixed material; however, on the contrary, the solidification may be performed, for example, by supplying the mixed material into a sodium carbonate solution or lime water.

In the case described above, an abrasive cleaning agent having a predetermined particle size may be obtained by receiving the mixed material, before a sodium carbonate solution or lime water is added thereto, for example, in a cylindrical container in which one open end portion is covered with a lid having many small holes, then extruding the material through the small holes to form thread shapes, further supplying the material into a sodium carbonate solution or lime water to form a solidified material, and finally drying and pulverizing.

Method 3 for Manufacturing Abrasive Cleaning Agent

In the above two manufacturing methods, a method has been described in which the abrasive cleaning agent is obtained after tubers of devil's tongue are dried and pulverized; however, the abrasive cleaning agent of the present invention may be directly manufactured from raw tubers of devil's tongue without subjecting them to a process including drying and pulverizing.

In the case described above, an abrasive cleaning agent of the present invention may be obtained as described below. That is, after raw tubers of devil's tongue are peeled, if necessary, the tubers thus processed or tubers which are further processed, for example, by cutting into a predetermined size or by grating are stirred while being boiled, and once agglomerates are formed, they are mashed up. Next, after hot water in an amount of 3 to 4 times that of the tubers thus processed is added thereto for water content adjustment, a sodium carbonate solution or lime water at a concentration of 1.5% and in an amount of approximately one third to one fourth of that of the hot water which was previously used is added for solidification to form a solidified material, and after this solidified material is dried to have a water content of approximately 20%, pulverization is performed so as to obtain an abrasive cleaning agent having a particle size of #60 to #80.

In the case described above, the addition of the abrasive grains is performed between the start of boiling the tubers of devil's tongue and the addition of the sodium carbonate solution or lime water.

In addition, in this manufacturing method, as in the case of the manufacturing method 2, the abrasive cleaning agent of the present invention may be obtained by receiving the mixed material, before a sodium carbonate solution or lime water is added thereto, for example, in a cylindrical container, then extruding or the like the material to form thread shapes, further supplying the material into a sodium carbonate solution or lime water to form a solidified material, and finally drying and pulverizing.

A Method For Polishing

The abrasive cleaning agent of the present invention obtained as described above can be used for a polishing process to form a mirror surface of a workpiece.

Workpieces

A polishing process according to the method of the present invention may be applied to various workpieces comprised of various materials and having various shapes, and besides metal products, ceramic and resin products may also be processed. In particular, by the method of the present invention, a mirror polishing process may be relatively easily performed on a workpiece, such as a mold having a complicated three-dimensional shape, which is difficult to be mirror-finished by standard lapping.

In addition, the polishing process of the present invention may also be used, for example, to remove minute burr or the like which are formed when a workpiece is microfabricated, and may also be applied to various workpieces which are required to be processed by an intended desired polishing process while suppressing changes in external shape of a workpiece as much as possible.

Treatment Conditions

Ejecting Apparatus

As an apparatus for ejecting an abrasive cleaning agent onto a surface of a workpiece, for example, various known blasting machines may be used. Various dry blasting machines may be used as this blasting machine, such as a blasting machine in which an abrasive cleaning agent is ejected by a centrifugal force of a rotary blade or by a collision with a rotary blade, and a blasting machine in which an abrasive cleaning agent is ejected with a compressed gas ejected from a nozzle.

In this embodiment, among the blasting machines mentioned above, a blasting machine ejecting an abrasive cleaning agent together with a compressed gas will be described by way of example.

This embodiment employs an air-type blasting machine in which compressed air is used as the compressed gas and the ejection pressure, ejection velocity, and the like of an abrasive cleaning agent are easily adjustable, for example, by the pressure of compressed air introduced into a nozzle. Various types of air-type blasting machines may be used, including for example, a direct-pressure-type blasting machine in which compressed air is supplied into a tank containing an abrasive cleaning agent, and the abrasive cleaning agent conveyed by the compressed air is ejected from the nozzle together with a flow of compressed air which is supplied from a different source, and a suction-type blasting machine in which an abrasive cleaning agent is drawn into a nozzle using an ejection phenomenon generated therein, followed by ejection. In addition, various types of blasting machines may be used as this suction-type blasting machine, including for example, a gravity-type blasting machine in which an abrasive cleaning agent falling from a tank therefore by gravity is ejected together with compressed air, and a siphon-type blasting machine in which an abrasive cleaning agent sucked by a reduced pressure generated by ejection of compressed air is ejected together with compressed air.

Figure 2:
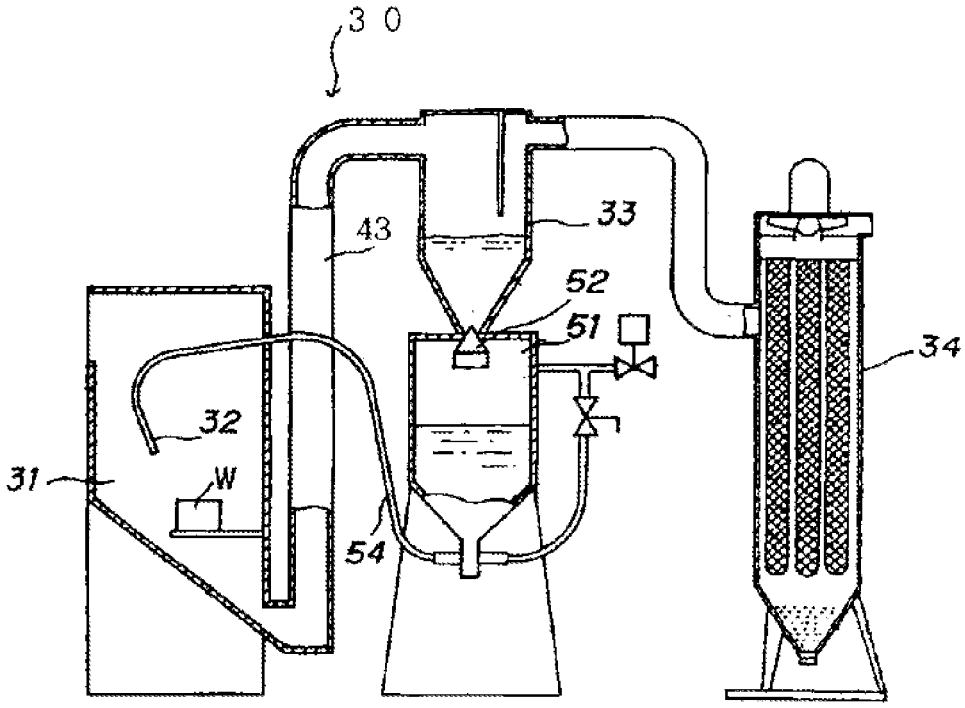
FIG. 2 is a schematic view of a direct-pressure-type blasting machine which is one example of an ejection apparatus ejecting an abrasive cleaning agent.

Among the above air-type blasting machines, the suction-type (gravity-type) and the direct-pressure-type are shown in FIGS. 1 and 2, respectively.

FIG. 1 shows a machine in which an abrasive cleaning agent is drawn into a nozzle 32 using an ejection phenomenon generated in the nozzle 32, which is generally used as a suction-type (gravity-type) sandblasting machine.

In the machine shown in FIG. 1, an abrasive cleaning agent 36 is first charged in a cabinet 31. The abrasive cleaning agent 36 thus charged is drawn into an abrasive cleaning-agent tank 33, which also functions as a cyclone, through a conduit 43 by a reduced pressure in a dust collector 34. The nozzle 32 is a suction-type ejection nozzle which draws in a fixed amount of the abrasive cleaning agent in the tank 33 by reducing the pressure inside an abrasive cleaning-agent supply hose 41 by means of the ejection phenomenon, using the compressed air supplied through an air hose 44 communicating with a compressed-air supply source (not shown), and ejects the abrasive cleaning agent from the nozzle tip 14 together with compressed air.

Figure 3:
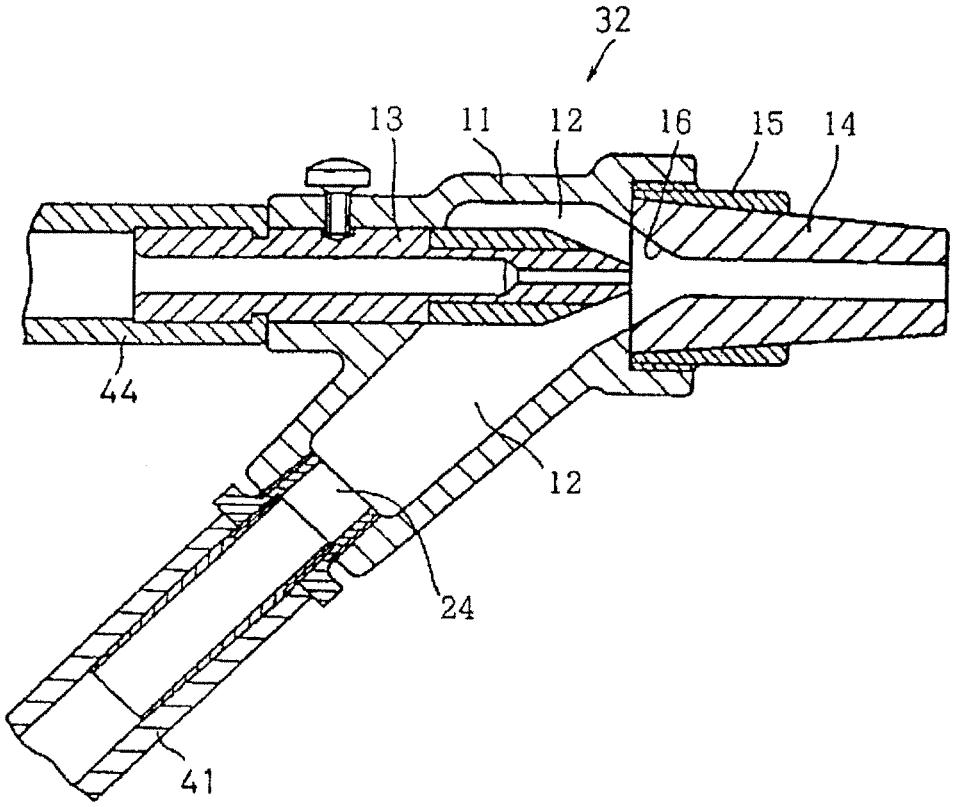
FIG. 3 is a vertical cross-sectional view of the suction-type blasting machine.
Figure 4A:
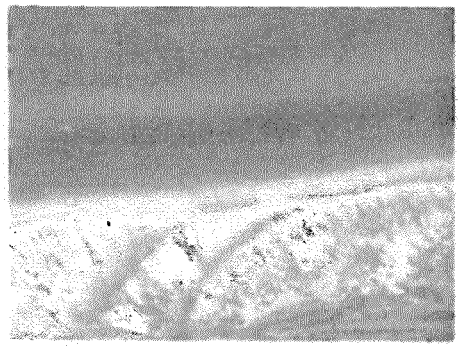
FIGS. 4A to 4E are microscope photographs showing treatment effects obtained in Examples 1 to 4 and a Comparative Example.
Figure 4A:
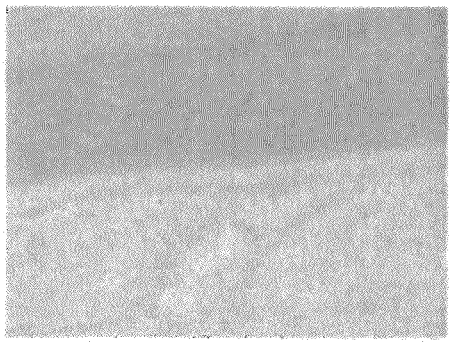
Figure 4B:
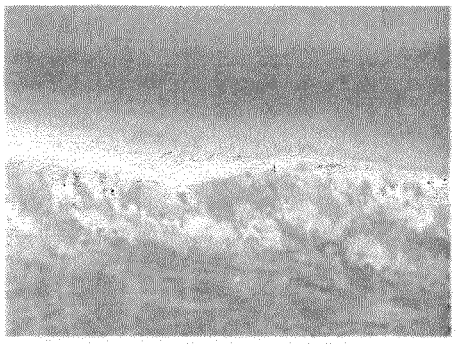
Figure 4B:
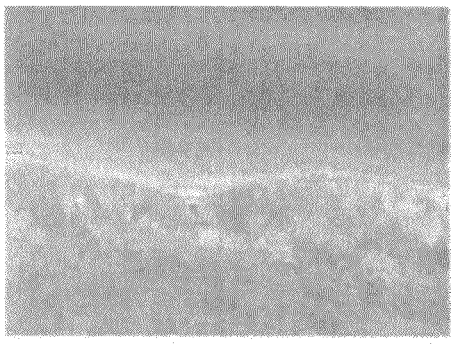
Figure 4C:
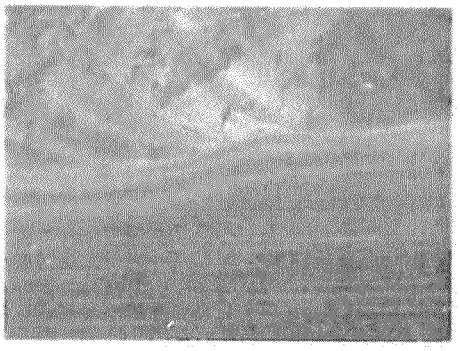
Figure 4C:
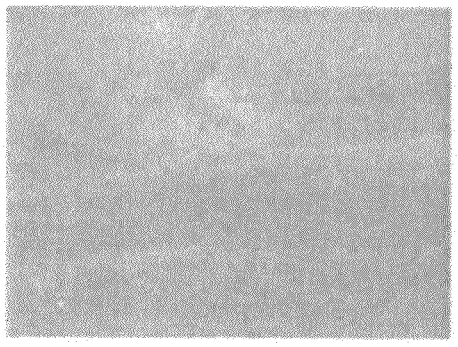
Figure 4D:
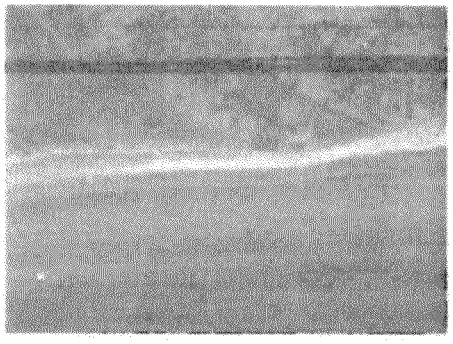
Figure 4D:
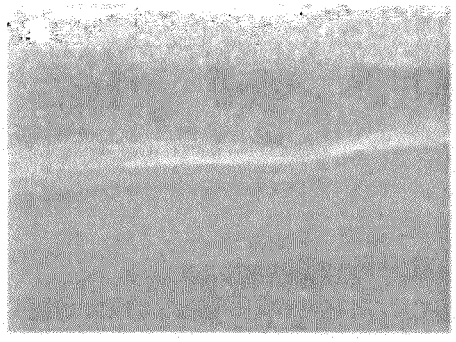
Figure 4E:
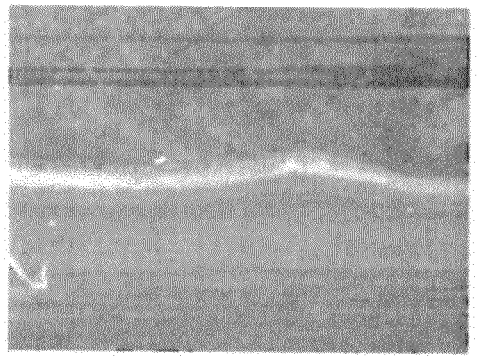
Figure 4E:
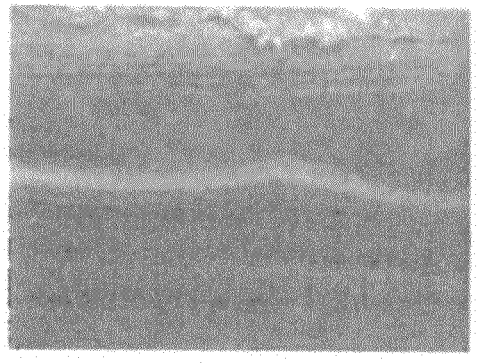

One example of this suction-type ejection nozzle 32 is shown in FIG. 3. The nozzle 32 shown in FIG. 3 has a nozzle base 11, and this nozzle base 11 forms an abrasive cleaning-agent suction chamber 12 having an approximately cylindrical container shape, and the chamber communicates with an abrasive cleaning-agent inlet 24 which connects to the abrasive cleaning-agent tank 33 intermediately through the abrasive cleaning-agent supply hose 41, and the chamber 12 into which the abrasive cleaning agent is sucked. In addition, at a front end portion of this abrasive cleaning-agent suction chamber 12, a conical inside surface 16 that is narrowed in the shape of a cone is formed, and a nozzle tip that penetrates this conical inside surface 16 is formed.

In addition, inside the conical inside surface 16, a front end of a jet 13 which communicates with the compressed-air supply source (not shown) at the back end thereof is inserted from a rear side of the abrasive cleaning-agent suction chamber 12, and it is designed such that compressed air supplied from the compressed-air supply source (not shown) can be ejected from a front ejection hole of the jet 13.

Reference numeral 15 is a holder, formed in the shape of a cylinder having a tapered portion in the inner circumferential surface thereof. A tapered portion of the outer circumference of the nozzle tip 14 is engaged with the tapered portion on the inner circumference of the holder 15, and the nozzle tip 14 is fixed to the nozzle base 11 by screwing the holder 15 to the nozzle base 11 with a threaded portion provided around an outer circumference thereof.

In the nozzle 32 thus formed, when high-pressure air is ejected from the front end of the jet 13 which communicates with the compressed-air supply source through the hose 44, since the pressure inside the abrasive cleaning-agent suction chamber 12 is reduced, the abrasive cleaning agent in the abrasive cleaning-agent lank 33 is sucked into the abrasive cleaning-agent suction chamber 12 through the abrasive cleaning-agent hose 41 by this reduced pressure.

The abrasive cleaning agent in the abrasive cleaning-agent suction chamber 12 is sucked into an annular portion between the conical inside surface 16 and the inner circumference of the jet 13 and is then ejected outside together with an air stream ejected from the jet 13 while being comically diffused from the nozzle tip.

As one example, in this embodiment, the front hole of the jet 13 has a diameter of 3 to 4 mm, the front hole of the nozzle tip has a diameter of 7 to 9 mm, and the pressure of compressed air ejected from the front end of the jet 13 is set to 0.05 MPa or more.

In addition, as the blasting machine 30, for example, when a centrifugal method, which is different from the above-described method using compressed gas, is used, the abrasive cleaning agent is ejected at a velocity of 30 m/s or more.

FIG. 2 shows a machine in which compressed air is fed into an abrasive cleaning-agent pressure feed tank 51 from a compressed-air supply source (not shown), and in which an abrasive cleaning agent is pressure-fed together with the compressed air and is ejected from the nozzle 32. This machine is generally used as a direct-pressure-type sandblasting machine.

In the machine shown in FIG. 2, the abrasive cleaning agent is first charged in the cabinet 31. The abrasive cleaning agent thus charged is drawn by a reduced pressure in the dust collector 34 and is then supplied to the recovery tank 33, which also functions as a cyclone, through the conduit 43.

A predetermined amount of the abrasive cleaning agent which is supplied in the recovery tank 33 is fed to the abrasive cleaning-agent pressure feed tank 51 by opening and closing of a dump valve 52. Compressed air is supplied into the abrasive cleaning-agent pressure feed tank 51 from the compressed-air supply source (not shown), and the abrasive cleaning agent pressurized by this compressed air thus supplied is fed into the direct-pressure ejection nozzle 32 through a hose 54 together with the compressed air and is then ejected together therewith from the nozzle tip 14 provided at the front end of the nozzle 32.

When a desired abrasive cleaning agent is charged in the cabinet 31 of the blasting machine 30 formed as described above, and when the machine is driven, the abrasive cleaning agent is ejected together with compressed air from the nozzle tip 14 and collides with a surface of a workpiece W.

This collision is performed at an acute incident angle with respect to the workpiece. When an incident angle of ejection performed perpendicular to the surface of the workpiece is regarded as 90°, the ejection is performed at an incident angle in the range of 60° to 15°.

When ejecting of the abrasive cleaning agent is performed in a predetermined range of acute inclined angles, the abrasive polishing agent ejected onto the workpiece slides on the surface thereof, and as a result, a polishing process is performed on the surface of the workpiece.

As described above, since the abrasive cleaning agent, which collides with the surface of the workpiece W, is comprised of an elastic material including a soluble nitrogen substance as a primary component, which primarily contains mannan, and 10% to 30% of water; and abrasive grains which are supported by surfaces of the elastic material and/or which are buried therein, although the abrasive cleaning agent simultaneously has good elasticity and appropriate adhesive properties, no stains, such as water or oil, adhere to the surface of the workpiece, and an appropriate polishing process can be performed thereon without scratching the workpiece.

In addition, since it has appropriate elasticity, the abrasive cleaning agent of the present invention is not likely to be crushed when it collides with the workpiece, and as a result, the problem of contamination of the working environment and/or workpieces, which is caused by the generation of dust due to crushing, is unlikely to occur.

In addition, since the above elastic material has hydroscopic properties and contains an appropriate water content, even when a resin molded material or the like is processed as a workpiece, the generation of static electricity is suppressed even when collisions occur, and adhesion of dust or the like to the surface of the workpiece due to the generation of static electricity can be prevented: hence, even when the abrasive cleaning agent of the present invention is used, for example, for deburring, on an electronic component or the like serving as a workpiece, for example, damage caused by the generation of static electricity can be prevented.

Furthermore, the mannan, a primary component of the soluble nitride substance which primarily forms the elastic material, has a high water retention ability, and therefore, even when the abrasive cleaning agent collides with the surface of the workpiece, the water contained in the mannan does not adhere to the surface of the workpiece. As a result, a procedure for removing it, such as wiping, is not required.

When the abrasive cleaning agent used for polishing a workpiece as described above is disposed of, for example, by incineration, since the weight thereof can be decreased to approximately 2% of that before the incineration, and since the elastic material is formed of 100% vegetable-based raw material, for example, incineration can be performed without generating any harmful materials, and the abrasive cleaning agent can be disposed of very easily. Accordingly, compared to a conventional abrasive cleaning agent in which a synthetic rubber or a synthetic resin is used as an elastic material, and in which abrasive grains are supported thereby or compounded therewith, the abrasive cleaning agent of the present invention rarely has an adverse influence on the environment and the like.

Next, Examples in which polishing processes were performed using the abrasive cleaning agent of the present invention will be described.

Polishing Process Test

The following product was used as a workpiece, and a polishing process according to the method of the present invention was performed thereon.

Workpiece: Welded portion of polished plate of SUS304: polishing process for an oxidized surface.

EXAMPLE 1

To a pulverized powder between size #46 (average particle diameter: approximately 350 μm) and #60 (average particle diameter: approximately 250 μm) obtained by drying and pulverizing tubers of devil's tongue, 20 percent by weight of water was added and absorbed, thereby forming 500 grams of an elastic material. To this elastic material, 50 grams of abrasive grains of SiC of size #800 (average of average particle diameter: 22.0 to 18.0 μm) was added so as to adhere to surfaces of the plastic material, thereby forming the abrasive cleaning agent of the present invention.

This abrasive cleaning agent was ejected using a sandblasting machine (gravity-type, "SGF-4" manufactured by Fuji Manufacturing Co., Ltd.) for treatment. The process conditions of this Example were as shown in the following Table 1.

TABLE 1

| Process Conditions (Example 1) | |
|---|---|
| Blasting Machine | Gravity type |
| Eject Pressure | 0.1 MPa |
| Eject Nozzle Diameter | 9 mm |
| Nozzle Distance | 100 to 150 mm |
| Nozzle Angle | 30° |

EXAMPLE 2

To a pulverized powder between size #60 and #80 obtained by drying and pulverizing tubers of devil's tongue, 20 percent by weight of water was added and absorbed, thereby forming 500 grams of an elastic material. To this elastic material, 50 grams of glass beads ("EMB-20" manufactured by Potters-Ballotini Co., Ltd.; average particle diameter: 10 μm) was added so as to adhere to surfaces of the elastic material, thereby forming an abrasive cleaning agent.

This abrasive cleaning agent was ejected using a sandblasting machine (gravity-type, "SGF-4" manufactured by Fuji Manufacturing Co., Ltd.) for treatment. The process conditions in this Example were as shown in the following Fable 2.

TABLE 2

| Process Conditions (Example 2) | |
|---|---|
| Blasting Machine | Gravity type |
| Eject Pressure | 0.05 MPa |
| Eject Nozzle Diameter | 9 mm |
| Nozzle Distance | 100 to 150 mm |
| Nozzle Angle | 30° |

EXAMPLE 3

To a pulverized powder between size #60 and #80 (average particle diameter: 250 to 149 μm) obtained by drying and pulverizing tubers of devil's tongue, 20 percent by weight of water was added and absorbed, thereby forming 500 grams of an elastic material. To this elastic material, 50 grams of abrasive grains of SiC of size #3000 (average particle diameter: 5.9 to 4.7 μm) was added so as to adhere to surfaces of the elastic material, thereby forming an abrasive cleaning agent.

This abrasive cleaning agent was ejected using a sandblasting machine (gravity-type, "SGF-4" manufactured by Fuji Manufacturing Co., Ltd.) for treatment. The process conditions in this Example were as shown in the following Table 3.

TABLE 3

| Process Conditions (Example 3) | |
|---|---|
| Blasting Machine | Gravity type |
| Eject Pressure | 0.075 MPa |
| Eject Nozzle Diameter | 9 mm |

TABLE 3-continued

| Process Conditions (Example 3) | |
|---|---|
| Blasting Machine | Gravity type |
| Nozzle Distance | 100 to 150 mm |
| Nozzle Angle | 30° |

EXAMPLE 4

A pulverized material obtained by drying and pulverizing tubers of devil's tongue was further processed to remove starch, fibers, and the like therefrom using a devil's tongue milling machine, so that 500 grams of devil's tongue powder was obtained. To this devil's tongue powder, water in an amount of approximately 10 times that of the powder and 50 grams of white alumium (WA) of size #1000 (average particle diameter: 18.0 to 14.5 μm) as abrasive grains were added to form a mixed material, followed by stirring. Subsequently, after being heated, this mixed material was solidified by addition of a sodium carbonate solution to form a solidified material, and this solidified material was cut into an appropriate size and was then dried to have a water content of approximately 20%.

The dried and solidified material was pulverized and sieved to obtain an abrasive cleaning agent between size #60 and #80 (average particle diameter: 250 to 149 μm), and this abrasive cleaning agent was ejected using a sandblasting machine (gravity-type, "SGF-4" manufactured by Fuji Manufacturing Co., Ltd.) for treatment. The process conditions in this Example were as shown in the following Table 4.

TABLE 4

| Process Conditions (Example 4) | |
|---|---|
| Blasting Machine | Gravity type |
| Eject Pressure | 0.075 MPa |
| Eject Nozzle Diameter | 9 mm |
| Nozzle Distance | 100 to 150 mm |
| Nozzle Angle | 30° |

COMPARATIVE EXAMPLE

In this Comparative Example, 50 grams of abrasive grains of WA (while alundum) of size #1000 (average particle diameter: 18.0 to 14.5 μm) was used, which was supported on surfaces of 500 grams of an elastic material made of a synthetic resin (melamine resin) of size #60 to #80 (average particle diameter: 250 to 149 μm), and an ejection treatment was performed under the conditions shown in the following Table 5.

TABLE 5

| Process Conditions (Comparative Example) | |
|---|---|
| Blasting Machine | Gravity type |
| Eject Pressure | 0.075 MPa |
| Eject Nozzle Diameter | 9 mm |
| Nozzle Distance | 100 to 150 mm |
| Nozzle Angle | 30° |

In the Comparative Example, since the ejection pressure was low, the crushing ratio was not so different from that of the Examples; however, it was found that the polishing efficiency was low because of the generation of static electricity, and the flow of abrasive grains was insufficient.

Measurement of Lower Limit of Ejection Pressure

By using the abrasive cleaning agent of Example 1, the lower limit of the ejection pressure at which the polishing process could be performed was measured by changing the ejection pressure in a step-wise manner. Polishing could be performed down to a pressure of 0.05 MPa.

For comparison, by using the abrasive cleaning agent of the above Comparative Example, the lower limit of the ejection pressure was measured in a manner similar to that described above. The limit was 0.075 MPa.

Experimental Results

Results of Polishing Process Test

For the workpiece described above, the polishing processes of Examples 1 to 4 and the Comparative Example were performed. The results are shown in the following Table 6.

In this experiment, the crushing ratio (%) was obtained from (weight of recovered abrasive cleaning agent/weight before ejection )×100,

TABLE 6

Results of Polishing Process Test

| | Example 1 | Example 2 | Example 3 | Example 4 | Comparative Example |
|---|---|---|---|---|---|
| Condition of Processed Workpiece | Removal of Scales | Removal of Adhering materials | Removal of Scales | Slight Removal of Scales | Incomplete Removal of Adhering Materials |
| Generation of Static Electricity | No | No | No | No | Yes |

As apparent from the above results, according to the abrasive cleaning agent of the present invention, while the generation of static electricity is prevented, the crashing ratio of the abrasive cleaning agent is low, and a polishing process can be performed similar to that by a related abrasive cleaning agent using a synthetic resin as an elastic material.

FIGS. 4A to 4E show the results of the polishing processes of Examples 1 to 4 and the Comparative Example. Between the results of Example 4 and the Comparative Example, which used the same material for the abrasive grains, an apparent difference in polishing performance could be observed.

Measurement of Lower Limit of Eject Pressure

As described above, the abrasive cleaning agents of Example 1 and the Comparative Example were ejected onto the workpiece while changing the ejection pressure, and the lower limit of the ejection pressure at which the polishing process could be performed was measured. As a result, by using the abrasive cleaning agent of the present invention, even when the ejection pressure was decreased to 0.05 MPa, a desired polishing process could be performed on the workpiece surface.

On the other hand, when the abrasive cleaning agent of the Comparative Example was used, when the ejection pressure was decreased to 0.075 MPa, a desired polishing process could not be performed. Hence, it was confirmed that when the abrasive cleaning agent of the present invention was used, although the ejection pressure was decreased below that of the related abrasive cleaning agent, the polishing process could be performed satisfactorily.

As described above, the reason the mirror polishing process can be performed by using the abrasive cleaning agent of the present invention at a lower ejection pressure than that by using the abrasive cleaning agent of the Comparative Example, which used a melamine resin as an elastic material, is believed to be that, although the specific gravity of the abrasive cleaning agent using a melamine resin as a core material is approximately 1.5, the abrasive cleaning agent of the present invention has a higher specific gravity of 2.0.

That is, due to the higher specific gravity as described above, even when ejecting is performed at a relatively low ejection pressure, a large collision energy can be obtained, and as a result, it is believed that the polishing process can be performed satisfactorily even when ejecting is performed at a low ejection pressure.

In addition, it is also believed that, since the adhesion rate of the abrasive grains of the abrasive cleaning agent according to the present invention is high, the polishing efficiency can be increased.

Thus the broadest claims that follow are not directed to a machine that is configured in a specific way. Instead, said broadest claims are intended to protect the heart or essence of this breakthrough invention. This invention is clearly new and useful. Moreover, it was not obvious to those of ordinary skill in the art at the time it was made, in view of the prior art when considered as a whole.

Moreover, in view of the revolutionary nature of this invention, it is clearly a pioneering invention. As such, the claims that follow are entitled to very broad interpretation so as to protect the heart of this invention, as a matter of law.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described;

What is claimed is:

1. A method for polishing comprising the step of ejecting an abrasive cleaning agent comprising:

an elastic material which includes a soluble nitrogen substance as a primary component, obtained from tubers of devil's tongue starch and containing mannan as primary component, and whose water content is 10% to 30%; and abrasive grains having an average grain diameter of 53 μm or less, which are provided in an amount of 1 to 30 percent by weight, with respect to the elastic material, and which are supported on surfaces of the elastic material and/or are buried in the elastic material, wherein;

a grain diameter of the abrasive cleaning agent is from 88 to 1190 μm;

onto a workpiece at an acute incident angle using a dry ejecting method with an ejection velocity of 30 m/s or more or an ejection pressure of 0.05 MPa or more.

* * * * *